US006753488B2

(12) United States Patent
Ono et al.

(10) Patent No.: US 6,753,488 B2
(45) Date of Patent: Jun. 22, 2004

(54) MICROSWITCH AND METHOD OF MANUFACTURING THE SAME

(75) Inventors: Tomio Ono, Yokohama (JP); Tadashi Sakai, Yokohama (JP); Naoshi Sakuma, Yokohama (JP); Mariko Suzuki, Yokohama (JP)

(73) Assignee: Kabushiki Kaisha Toshiba (JP)

( * ) Notice: Subject to any disclaimer, the term of this patent is extended or adjusted under 35 U.S.C. 154(b) by 0 days.

(21) Appl. No.: 10/661,660

(22) Filed: Sep. 15, 2003

(65) Prior Publication Data

US 2004/0075514 A1 Apr. 22, 2004

(30) Foreign Application Priority Data

Sep. 20, 2002 (JP) ..... 2002-274365

(51) Int. Cl.[7] ..... H01H 57/00
(52) U.S. Cl. ..... 200/181; 335/78; 257/414
(58) Field of Search ..... 200/181, 246; 335/78, 79, 85, 86; 257/414, 420

(56) References Cited

U.S. PATENT DOCUMENTS 5,944,537 A * 8/1999 Smith et al. ..... 439/81
6,087,638 A * 7/2000 Silverbrook ..... 219/540
6,191,671 B1 * 2/2001 Schlaak et al. ..... 335/78
6,384,353 B1 * 5/2002 Huang et al. ..... 200/181
6,422,077 B1 * 7/2002 Krauss et al. ..... 73/514.25

OTHER PUBLICATIONS

Paul M. Zavracky, et al., "Micromechanical Switches Fabricated Using Nickel Surface Micromachining", Journal of Microelectromechanical Systems, vol. 6, No. 1, Mar. 1997, pp. 3–9.
S. Ertl, et al., "Surface Micromachined Diamond Microswitch", Diamond and Related Materials, vol. 9, 2000, pp. 970–974 No month.
M. Adamschik, et al., "Diamond Microwave Micro Relay", Diamond and Related Materials vol. 11, 2002, pp. 672–676 No month.

* cited by examiner

*Primary Examiner*—Lincoln Donovan
*Assistant Examiner*—K. Lee
(74) *Attorney, Agent, or Firm*—Oblon, Spivak, McClelland, Maier & Neustadt, P.C.

(57) ABSTRACT

Fine holes each having a diameter of scores of nanometers are formed in each of diamond thin films at an interval equal to the diameter of the fine hole, and metal electrodes each having a low resistivity are buried in the fine holes, and the distance between metal electrodes and the diamond thin films through which flows an electric current is set at an order of scores of nanometers so as to markedly lower the on-resistance. As a result, provided is a microswitch having a low on-resistance and utilizing the high reliability inherent in diamond.

12 Claims, 3 Drawing Sheets

MICROSWITCH AND METHOD OF MANUFACTURING THE SAME

CROSS-REFERENCE TO RELATED APPLICATIONS

This application is based upon and claims the benefit of priority from the prior Japanese Patent Application No. 2002-274365, filed Sep. 20, 2002, the entire contents of which are incorporated herein by reference.

BACKGROUND OF THE INVENTION

1. Field of the Invention

The present invention relates to a microswitch and a method of manufacturing the same, particularly, to a microswitch using a thin film made of a carbon series material and a method of manufacturing the same.

2. Description of the Related Art

In recent years, attentions are paid to a MEMS (Micro Electro Mechanical Systems) technology for manufacturing an integral structure comprising a fine mechanical structure and an electronic circuit by using a semiconductor fine fabrication technology. The MEMS technology is employed in various technical fields including, for example, a fine mechanical switch, hereinafter referred to as "microswitch". The microswitch exhibits frequency characteristics which are more satisfactory than the semiconductor switch and, thus, is expected to be utilized in the field of telecommunications. Also, the microswitch can be miniaturized and integrated more easily than the conventional relay utilizing the electromagnetic force and, thus, is expected to be utilized in the field of vehicles.

As an example of the microswitch utilizing the particular MEMS technology, a microswitch manufactured by utilizing the Ni plating is disclosed in "Paul M, Zavracky et al., Micromechanical Switches Fabricated Using Niker Surface Micromachining", which is reported in "Journal of Microelectro Mechanical Systems, (USA), (IEEE/IEE), 1997, Vol. 6, p. 3, FIG. 2".

The method of manufacturing the microswitch is schematically illustrated in FIG. 2 of the publication noted above, and the fabrication procedure is described in this publication with reference to FIG. 2. In the fabrication procedure disclosed in this publication, a silicon oxide film is formed first on a Si substrate, followed by forming on the silicon oxide film a Cr film and a Au film forming a first contact layer. Then, a source electrode, a gate electrode and a drain electrode are formed by the patterning using the photolithography. After formation of these electrodes, a Cu film acting as a sacrificial layer is formed, followed by etching the Cu layer so as to form a hemispherical concave portion and a hole extending to reach the source electrode. Then, a resist layer is patterned so as to form a Au film acting as a second contact layer and subsequently forming a beam by a Ni plating. Finally, the resist layer and the Cu layer acting as the sacrificial layer are removed so as to finish the manufacture of the device.

If a voltage is applied to the gate electrode in the microswitch of the construction described above, the beam is electrostatically deformed toward the substrate. If the voltage exceeds a certain value, the electrostatic force overcomes the elastic force of the beam so as to permit the hemispherical contact formed in the tip of the beam to be brought into contact with the drain electrode, with the result that the source-drain passageway is rendered conductive so as to form an "on" state. If the voltage ceases to be applied to the gate electrode, the beam is brought back to the original state, with the result that the contact is moved away from the drain electrode so as to form an "off" state.

In general, Au is widely used as a material of the contact included in the microswitch. It should be noted in this connection that the on-resistance of the microswitch includes in general a contact resistance and a film resistance. The contact resistance is derived from the situation that the irregularity on the contact surface causes the actual contact area to be markedly smaller than the apparent contact area. On the other hand, the covering resistance is derived from the situation that the contact surface is covered with a thin insulating layer. In order to diminish the former one of the contact resistance, it is necessary to increase the contact force so as to enlarge the contact area, or to use a material that is likely to be deformed. On the other hand, in order to diminish the latter one of the covering resistance, it is necessary to increase the contact force so as to mechanical destroy the insulating layer on the surface, or to use a material on which an insulating layer is unlikely to be formed. However, an electrostatic force is used in general as a driving force in the microswitch. What should be noted is that the electrostatic force is very small. In general, the electrostatic force is capable of generating only about $\mu$N to mN of the contact force. Such being the situation, Au, which can be deformed easily and on the surface of which an insulating film is not formed, is widely used as the material of the contact included in the microswitch.

However, the microswitch thus manufactured leaves room for further improvement in respect of its life. Particularly, Au used for forming the contact layer is known as a contact material that is likely to bring about a so-called "sticking", which is the phenomenon that the both poles thereof are stuck to each other so as to make it difficult to permit the both poles to be separated from each other. It follows that Au used for forming the contact layer is said to leave a problem in respect of the reliability for a long time.

A microswitch using a diamond thin film is reported as a measure for overcoming the sticking problem noted above in, for example, an article entitled "Surface micromachined diamond microswitch" included in a magazine "Diamond and Related Materials, Vol. 9, p.970, FIG. 2" by S. Ertl, et al, which was published by "Elsevier Science, the Netherlands" in 2000".

The method of manufacturing a microswitch by using a diamond thin film is illustrated in FIG. 2 of the publication quoted above. According to the description relating to FIG. 2, an i-type diamond thin film forming an insulating layer is formed first on a Si substrate. Then, a $p^+$-type diamond thin film having a high dopant concentration is formed, followed by patterning the $p^+$-type diamond thin film so as to form a gate electrode and a first contact layer. Further, a $SiO_2$ layer acting as a sacrificial layer is formed, followed by selectively etching the $SiO_2$ layer so as to form a convex portion and a hole. After the selective etching step, a $p^+$-type diamond thin film is formed, followed by pattering the diamond thin film so as to form a beam. In the beam forming step, a contact is formed at the tip of the beam. Finally, the sacrificial layer is removed so as to form a metal electrode, thereby finishing the manufacture of the device.

Likewise, a diamond microswitch structure is disclosed in, for example, an article entitled "Diamond microwave microswitch" by M. Adamschik, et al, which is included in a magazine "Diamond and Related Materials, Vol. 11, p.672"published by "Elsevier Science, the Netherlands" in 2002". Disclosed in this prior art is the structure that the current passageway starting from the metal electrode to reach again the metal electrode through the contact made of the $p_+$-type diamond and the first contact layer is made as short as possible. It is reported that the particular structure makes it possible to decrease the resistance component derived from the bulk resistance of the diamond thin film.

Graphite, which is made of carbon like diamond, is known to be a material that does not bring about the sticking problem and, thus, was widely used in the past as a material of the sliding contact. It is reported by the research group referred to above that the sticking is not brought about in diamond, too, as reported in, for example, an article entitled "Surface micromachined diamond microswitch" included in a magazine "Diamond and Related Materials, Vol. 9, p.970, FIG. 2" by S. Ertl, et al, which was published by "Elsevier Science, the Netherlands" in 2000".

Diamond exhibits satisfactory mechanical characteristics, the thermal conductivity, and the corrosion resistance and, thus, makes it possible to achieve a microswitch capable of stably switching a large current over a long period of time.

The microswitch using a diamond thin film referred to above exhibits satisfactory mechanical characteristics, the thermal conductivity, and the corrosion resistance. In addition, the sticking problem is unlikely to be generated in the microswitch using the diamond thin film. It follows that the microswitch using the diamond thin film provides the possibility of realizing a microswitch capable of stably switching a large current over a long period of time and excellent in its reliability.

However, a serious problem is left unsolved in the device disclosed in the prior art publication referred to above, as pointed out below. Specifically, diamond is basically a semiconductor. The resistivity of a $p^+$-type diamond (B-doped diamond) is at least 1,000 times as high as that of the ordinary metal. The on-resistance of the microswitch made of a metal is determined by substantially the contact resistance at the contact interface. However, the on-resistance of the microswitch made of diamond corresponds to the series resistance of the contact resistance and the bulk resistance of the diamond thin film, i.e., the sum of the contact resistance and the bulk resistance noted above. It follows that, even if the contact resistance is lowered by increasing the contact area by, for example, planarizing the contact surface, it is impossible to lower the on-resistance unless the series resistance is also lowered.

In the structure disclosed by S. Ertl et al, the thickness of the contact made of a $p^+$-type diamond thin film is decreased so as to diminish the distance between the metal electrode on the back surface and the contact surface. However, this technology is limited in terms of the mechanical strength of the diamond thin film. Also, the diamond film is formed in general by a CVD method. In the initial stage of the CVD process for forming the diamond film, the diamond is in the form of isolated particles. Since a continuous film is formed in the stage that the diamond film is allowed to have a reasonable thickness, it is difficult to form a thin continuous film itself. Further, in the structure in question, the distance between the contact surface and the electrode corresponds to the distance in a direction parallel to the film. It follows that it is difficult to decrease the resistance component in the first contact layer.

Incidentally, the sticking problem is unlikely to take place in graphite, which is also the carbon-based material, as in diamond. However, the problem that the resistivity is several places higher than that of metal is inherent in graphite as in diamond.

BRIEF SUMMARY OF THE INVENTION

An object of the present invention is to provide a microswitch having a low on-resistance, which utilizes the high reliability of a carbon-based material, and a method of manufacturing the particular microswitch.

According to an aspect of the present invention, there is provided a microswitch, comprising:

a substrate;

a first electrode portion fixed to the substrate and having a first contact surface, the first electrode portion including a first layer formed of a first carbon series material and provided with a group of first fine holes extending to reach the first contact surface, and first metal segments formed of a first metal material and buried in the first fine holes, respectively;

a second electrode portion arranged to face the first electrode portion with a gap provided therebetween and having a second contact surface movable toward the first electrode portion, the second electrode portion including a second layer formed of a second carbon series material and provided with a group of second fine holes each extending to reach the second contact surface, and second metal segments formed of a second metal material and buried in the second fine holes, respectively; and a deformable structure configured to support the second electrode portion on the substrate to face the second contact surface to the first contact surface with a gap in a non-contact state, and configured to be deformed to shift the second electrode portion and contact the second contact surface with the first contact surface in a contact state.

According to an another aspect of the present invention, there is provided a method of manufacturing a microswitch, comprising:

forming a first electrode portion having a first contact surface on a substrate such that the first electrode portion is fixed to the substrate, the forming the first electrode portion including:

forming a first carbon series material layer on the substrate;

forming a first metal layer on the first carbon series material layer;

subjecting the first metal layer to an anodic oxidation within an acidic solution so as to form a first porous film in at least a surface region of the first metal layer;

subjecting the first carbon series material layer to an anisotropic etching with the first porous film used as a mask so as to form a group of first fine holes; and burying a first metal material in each of the first fine holes;

forming a second electrode portion positioned to face the first electrode portion with a gap, the second electrode portion having a second contact surface movable toward the first electrode portion, the forming the second electrode portion including:

forming a sacrificial layer having a pattern on the substrate;

forming a second carbon series material layer on the sacrificial layer and on the substrate;

forming a second metal layer on the second carbon series material layer;

subjecting the second metal layer to an anodic oxidation within an acidic solution so as to form a second porous film in at least a surface region of the second metal layer;

subjecting the second carbon series material layer to an anisotropic etching with the second porous film used as a mask so as to form a group of second fine holes; and burying a second metal material in each of the second fine holes; and forming a deformable structure configured to support the second electrode portion on the substrate to face the second contact surface to the first contact surface with a gap in a non-contact state, and configured to be deformed to shift the second electrode portion and contact the second contact surface with the first contact surface in a contact state, the forming the deformable structure including removing the sacrificial layer.

DETAILED DESCRIPTION OF THE INVENTION

The microswitches according to some embodiments of the present invention will now be described in detail with reference to the accompanying drawings.

First Embodiment

Figure 1:
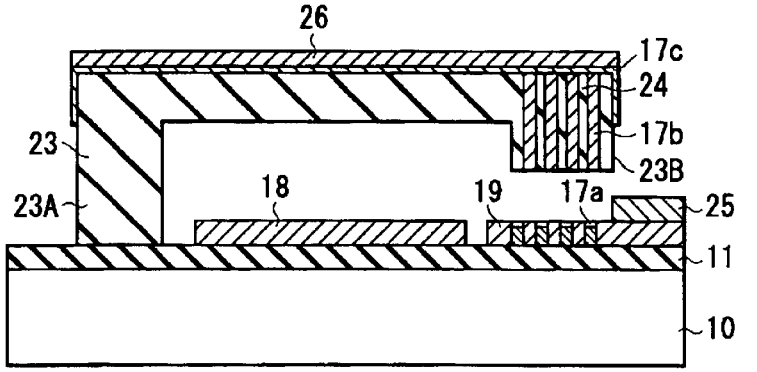
FIG. 1 is a cross sectional view schematically showing the construction of a microswitch according to a first embodiment of the present invention.

FIG. 1 is a cross sectional view schematically showing the construction of a microswitch using a diamond thin film according to a first embodiment of the present invention. On the other hand, FIGS. 2A to 2J are cross sectional views schematically showing collectively the process of manufacturing the microswitch shown in FIG. 1. Further, FIG. 3 is an oblique view schematically showing a model of a porous film shown in FIGS. 2C and 2D.

As shown in FIG. 1, the microswitch according to the first embodiment of the present invention has a so-called "cantilever" structure. To be more specific, a polycrystalline diamond thin film 11 is formed on a substrate 10. Also, a proximal end portion 23A of a substantially L-shaped beam 23 is fixed to the thin film 11, and the other end portion 23B of the beam 23 is formed free. A contact 24 is formed in the free end portion 23B.

A gate electrode 18 and a first contact layer 19 are formed on the polycrystalline diamond thin film 11. The first contact layer 19 is constructed such that Ni electrodes 17*a* are buried in fine holes 16 of a porous material, and a metal electrode 25 is formed on the first contact layer 19 so as to be electrically connected to the Ni electrodes 17*a*. The contact 24 of the beam 23 positioned to face the first contact layer 19 with a gap interposed therebetween is also constructed such that Ni electrodes 17*b* are buried in fine holes of a porous material. Also, a Ni layer 17*c* integral with the buried electrodes 17*b* is formed on the beam 23, and a metal electrode 26 is formed on the Ni layer 17*c* so as to permit the buried electrodes 17*b* to be electrically connected to the Ni layer 17*c*.

In the microswitch of the construction described above, the free end portion 23*b* having the contact 24 is moved toward the substrate upon application of a voltage to the gate electrode 18 so as to permit the contact 24 formed in the beam 23 to be brought into contact with the contact layer 19. As a result, the contact 24 is brought into a mechanical and electrical contact with the metal electrode 25. It follows that the metal electrode 26 is brought into an electrical contact with the metal electrode 25 via the nickel layers 17*a*, 17*b* and 17*c*.

The microswitch of the construction described above is manufactured by the process shown in FIGS. 2A to 2J. In the first step, prepared is a Si substrate 10 having a flat surface. An undoped polycrystalline diamond thin film 11 is formed in a thickness of about 2 $\mu$m on one main surface of the Si substrate 10 by, for example, a plasma CVD method. An acetone-methanol mixed solution is used as a carbon source required for forming the polycrystalline diamond thin film 11, and the carbon source is introduced into a chamber by means of a hydrogen bubbling of the solution. Concerning the growing conditions of the polycrystalline diamond thin film, the microwave power was set at 1.5 kW, the hydrogen flow rate was set at 200 sccm, the methane gas flow rate was set at 4 sccm, and the methane concentration of the raw material gas was set at 2%. Further, the gas pressure of the raw material gas was set at 133 hPa, and the substrate temperature was set at 850° C.

Figure 2A:
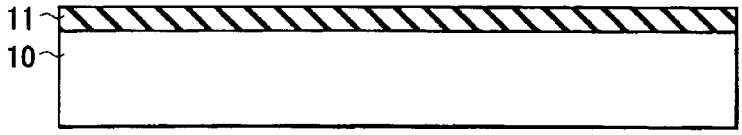
FIGS. 2A to 2J are cross sectional views collectively showing schematically the process of manufacturing the microswitch shown in FIG. 1.
Figure 2B:
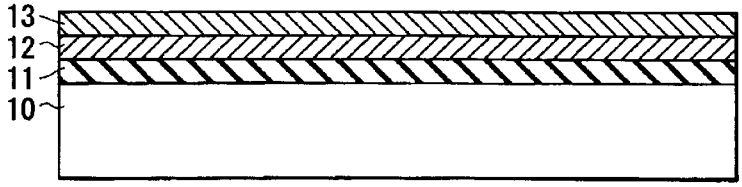
Figure 3:
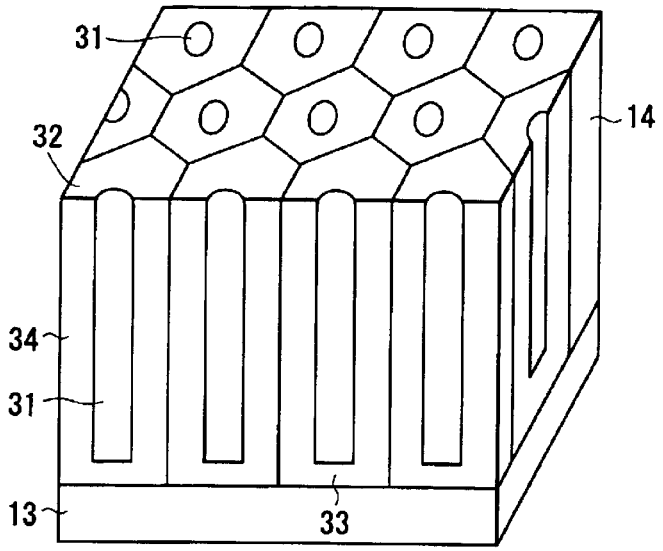
FIG. 3 is an oblique view schematically showing a model of a porous film shown in FIGS. 2C and 2D.

In the next step, a polycrystalline diamond thin film 12 doped with B (boron) was formed in a thickness of, for example, about 2 $\mu$m on the polycrystalline diamond thin film 11, as shown in FIG. 2B. Boron oxide ($B_2O_3$) was used as the B (boron) source such that boron oxide was dissolved in the acetone-methanol mixed solution. The growing conditions of the polycrystalline diamond thin film 12 were equal to those of the polycrystalline diamond thin film 11. In this case, it is possible to control the B (boron)/C (carbon) ratio by controlling the composition of the solution. For example, the diamond thin film manufactured by setting the B concentration in the liquid phase at $10^4$ ppm (B/C) exhibits a B concentration of about $10^{21}/cm^3$ and a resistivity of about $10^{-2}\Omega\cdot cm$ so as to exhibit a metal-like conductivity. Further, an Al thin film 13 is formed on the B-doped diamond thin film 12 by, for example, a vacuum deposition.

Figure 2C:
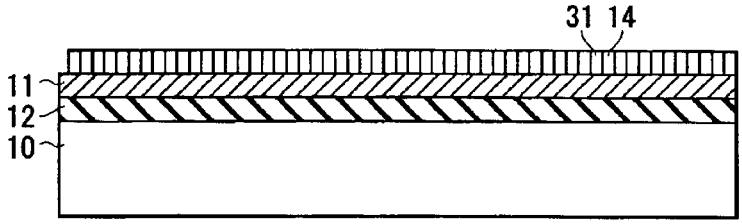

In the next step, the Al thin film 13 is subjected to an anodic oxidation within an acidic solution, as shown in FIG. 2C. In this case, the Al thin film 13 is oxidized by the electrolysis that is carried out within, for example, a sulfuric acid solution by connecting the Al thin film 13 to a positive electrode of a power source. As a result, a porous alumina ($Al_2O_3$) film 14 is formed on the surface of the Al thin film 13. The anodic oxidation is actually carried out until the most portion of the Al thin film 13 is converted into a porous film 14.

FIG. 3 shows a model of the porous film 14. As shown in the drawing, the film 14 is formed of an aggregate of hexagonal cells 32 each formed about a fine hole 31 perpendicular to the Al thin film 13 acting as an underlying metal layer. Also, a thin barrier layer 33 is formed in contact with the underlying metal layer 13 at the bottom of the fine hole 31. The fine holes 31 are formed at a density of $10^9$ to $10^{11}/cm^2$, the fine hole 31 has a diameter of 10 to 100 nm, and the barrier layer 33 has a thickness of 10 to 100 nm, which is substantially equal to the thickness of a wall 34 of the cell 32. It is possible to increase the thickness of the porous film 14, which is determined by the current density and the operating time in the anodic oxidation treatment, to about hundreds of microns. The anodic oxidation itself of Al, which is widely employed in various fields including, for example, an electrolytic capacitor, is an established technology.

Figure 2D:
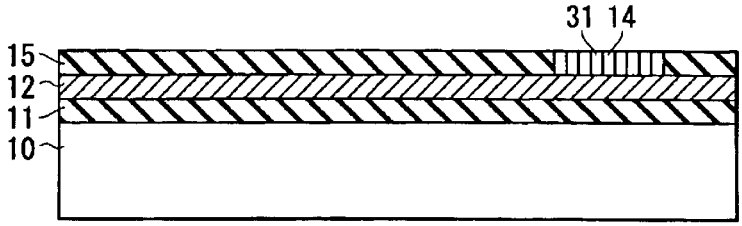

In the next step, a pore-sealing treatment is applied to the porous film 14 in the portion other than the portion forming a contact as shown in FIG. 2D. In this case, the portion where the porous film 14 is left unchanged is covered with a protective layer (not shown), and the other portion of the porous film 14 is brought into contact with a boiling water or a heated steam so as to carry out the pore-sealing treatment. As a result, the fine holes 31 are completely closed in the portion where the pore-sealing treatment was applied, and a film 15 consisting of $Al_2O_3$ is formed on the thin film 12.

Figure 2E:
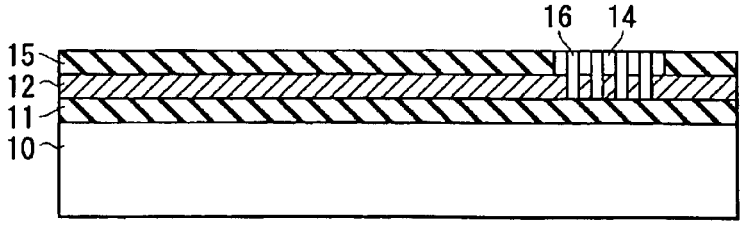

After formation of the $Al_2O_3$ film 15, the barrier layer 33 remaining at the bottom portion of the porous film 14 is removed by an anisotropic etching of RIE (reactive ion etching) in which the etching rate in a direction perpendicular to the substrate is high, as shown in FIG. 2E. Further, the B-doped diamond thin film 12 is removed by an anisotropic etching of RIE using an oxygen, with the porous film 14 and the $Al_2O_3$ film 15 used as a mask. As a result, a large number of fine holes 16 are formed in the B-doped diamond thin film 12. The density of the large number of fine holes (fine hole group) was found to be $10^9/cm^2$ to $10^{11}/cm^2$, and the diameter of each fine hole included in the fine hole group was found to be 10 nm to 100 nm.

Figure 2F:
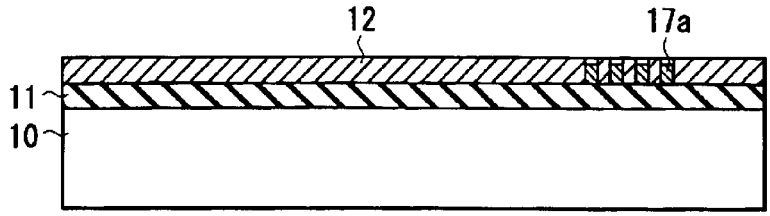

After the porous film 14 and the alumina film 15 having the pore-sealing treatment applied thereto are removed, a Ni electrode 17*a* is buried by, for example, a plating treatment in the fine hole 16, as shown in FIG. 2F. The Ni electrode 17*a* consists of an array of a large number of slender columnar Ni layers. In this case, it is possible for the upper surface of the B-doped diamond thin film 12 to be flush with the upper surface of the Ni electrode 17*a*. Alternatively, it is also possible to etch slightly the Ni electrode 17*a* after the plating treatment so as to make the upper surface of the Ni electrode 17*a* slightly lower than the upper surface of the B-doped diamond thin film 12.

Figure 2G:
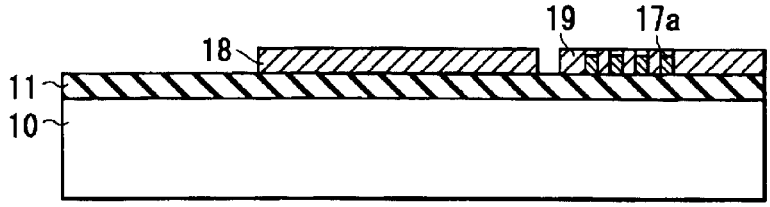

In the next step, the B-doped diamond thin film 12 is patterned so as to form a gate electrode 18 and a first contact layer 19, as shown in FIG. 2G. In patterning the diamond thin film 12, the diamond thin film 12 is etched by RIE (reactive ion etching) using an $O_2$ gas. Aluminum (Al) is used as a mask material in this etching step. Incidentally, the undoped polycrystalline diamond thin film 11 is somewhat etched in this etching step. However, the etching of the undoped polycrystalline diamond thin film does not give rise to any particular problem. It suffices to suppress the over-etching amount by controlling, for example, the etching time, if necessary.

Figure 2H:
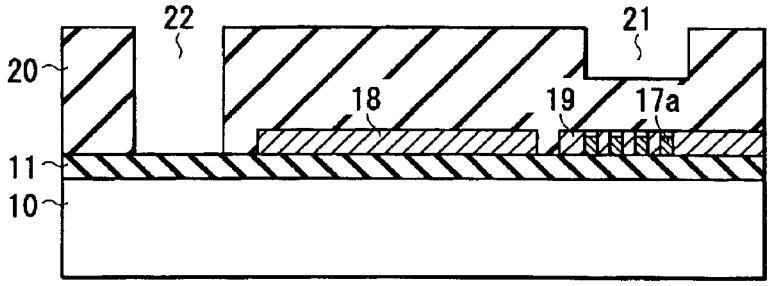
Figure 2I:
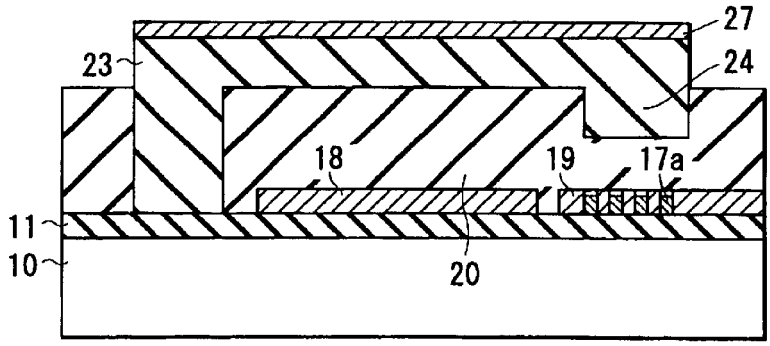

In the next step, a sacrificial layer 20 consisting of a $SiO_2$ layer is formed, followed by selectively etching the sacrificial layer 20 so as to form a concave portion 21 and a hole 22, as shown in FIG. 2H. Then, a diamond thin film doped with a high concentration of B is formed in a manner to fill the concave portion 21 and the hole 22 by a method similar to that described previously. Further, an Al thin film 27 is formed on the diamond thin film doped with B.

The Al thin film 27 thus formed is patterned in the next step by RIE using a $CCl_4$ gas, followed by patterning the diamond thin film doped with B by a method similar to that described previously so as to form a beam 23. In this step, a contact 24 is formed at the tip of the beam 23. It should be noted that the Al thin film 27 is left unremoved on the beam 23.

Figure 2J:
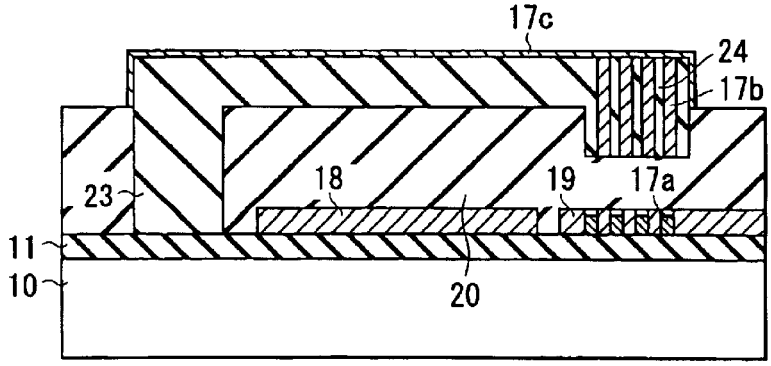

In the next step, the structure having a Ni electrode 17*b* buried in the contact 24 is formed as shown in FIG. 2J by the process similar to that described previously in conjunction with FIGS. 1C to 1F. To reiterate, the Al thin film 17 is subjected to an anodic oxidation within an acidic solution so as to form a porous $Al_2O_3$ (alumina) film on the surface of the Al thin film 17 as in FIG. 2C. Then, a pore-sealing treatment is applied to the porous alumina film in the portion other than the portion constituting the contact 24, as in FIG. 2D, with the result that the fine holes in the portion other than the portion constituting the contact 23 are completely closed, and a film consisting of $Al_2O_3$ (alumina) is formed on the beam 23. Further, the barrier layer remaining at the bottom portion of the porous film 14 is removed by an anisotropic etching of RIE (reactive ion etching) in which the etching rate in a direction perpendicular to the substrate is high, as in the case shown in FIG. 2E. Still further, a Ni electrode 17*b* is buried by, for example, a plating treatment in the fine hole 16 after removal of the porous film and the alumina film having the pore-sealing treatment applied thereto, as in the case shown in FIG. 2F. It follows that the Ni electrode 17*b* buried in the contact 24 is also constructed to form an array of a large number of slender columnar Ni layers. After the plating treatment, the Ni electrode is etched. However, the Ni electrode is not etched to permit the etching to reach the fine hole formed in the contact 24. In other words, the Ni electrode is etched to permit a thin Ni layer 17*c* to be left unremoved on the upper surface of the beam 23. Incidentally, it is possible to etch the Ni electrode to permit the etching to reach the fine hole formed in the contact 24, followed by forming a metal layer such as a Ni layer on the upper surface of the beam 23 so as to permit the metal layer thus formed to be electrically connected to the Ni electrode 17*b* buried in the fine hole.

In the next step, the sacrificial layer 20 is removed by etching with an etchant for the buffer etch ($HF+NH_4F$) so as to form a metal electrode 25 on the first contact layer 19 and a metal electrode 26 on the Ni layer 17*c*, as shown in FIG. 1, thereby finishing the manufacture of the device. Incidentally, it is possible for the contact surface of the contact 24 to be flush with the lower surface of the Ni electrode 17*b*. Alternatively, it is possible to etch slightly the Ni electrode 17*b* during or after removal of the sacrificial layer 20 so as to permit the lower surface of the Ni electrode 17*b* to recede from the contact surface of the contact 24. In other words, it is possible for the lower surface of the Ni electrode 17*b* to be formed within the fine hole in the contact 24, and it is possible for slightly deformed recesses to be formed in the contact 24.

In the first embodiment of the present invention described above, it is possible to form fine holes having scores of nanometers of the diameters within the diamond thin film at an interval substantially equal to the diameter of the fine hole. Also, metal electrodes 17*a* and 17*b* having a small resistivity are buried in the fine holes. It follows that the distance between the metal electrode and the contact of the diamond thin film through which flows an electric current is on the order of scores of nanometers so as to make it possible to markedly decrease the on-resistance without giving rise to problems in respect of, for example, the mechanical strength. As a result, it is possible to provide a microswitch using a diamond thin film having a low on-resistance while utilizing the high reliability of diamond. What should also be noted is that, since the metal electrodes 17*a* and 17*b* are buried in the fine holes, the resistance component generated by the distance between the contact surface of the diamond thin film and the metal electrode 25 can be decreased to a negligible level.

Second Embodiment

Figure 4A:
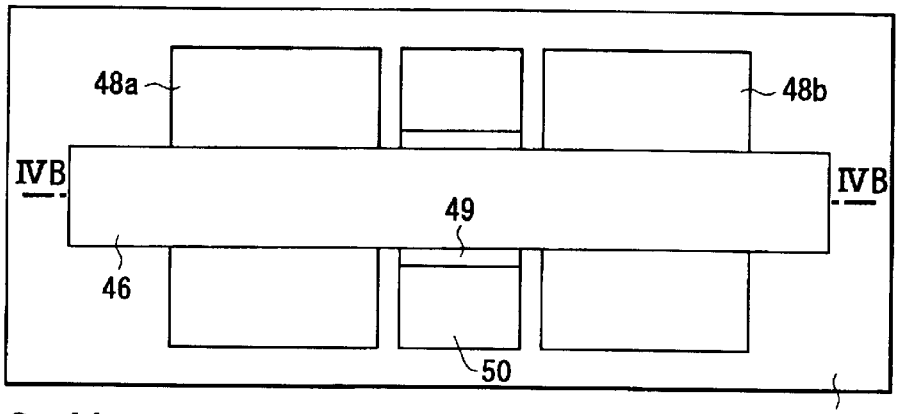
FIG. 4A and 4B are an upper view and a cross sectional view, respectively, schematically showing the construction of a microswitch according to a second embodiment of the present invention.
Figure 4B:
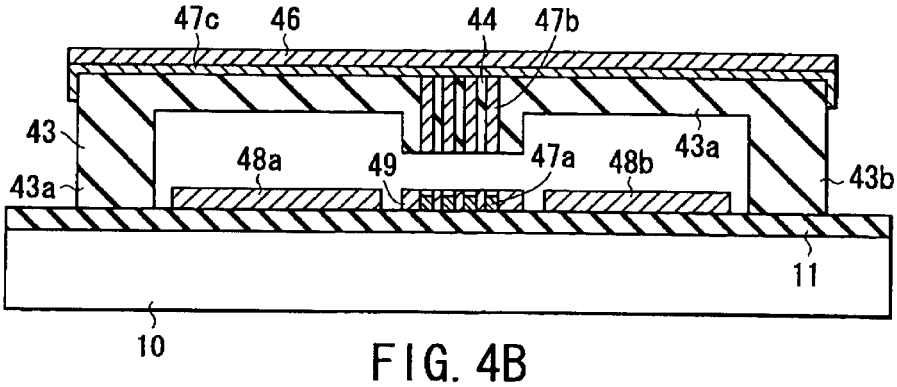

FIG. 4A is a plan view schematically showing the construction of a microswitch using a diamond thin film according to a second embodiment of the present invention, and FIG. 4B is a cross sectional view along the line A–A' shown in FIG. 4A. In FIGS. 4A and 4B, the same reference numerals are put to the portions corresponding to FIGS. 1 and 2A to 2J so as to avoid the overlapping description.

The microswitch according to the second embodiment of the present invention can be manufactured by the manufacturing method similar to that for the first embodiment of the present invention described above. The microswitch according to the second embodiment is constructed as described in the following. Specifically, a first contact layer 49 is formed in substantially the central region on the undoped polycrystalline diamond thin film 11 formed on the Si substrate 10, and gate electrodes 48*a*, 48*b* are formed on the polycrystalline diamond thin film 11 substantially in symmetry with respect to the first contact layer 49.

The first contact layer 49 and the gate electrodes 48*a*, 48*b* can be formed by patterning a polycrystalline diamond thin film doped with boron (B). A large number of fine holes are formed in the first contact layer 49 by a method similar to that employed in the first embodiment of the present invention described. previously, and a Ni electrode 47*a* are buried in the large number of the fine holes. The Ni electrode 47*a* is constructed to form an array of a large number of slender columnar Ni layers. It is possible for the upper surface of the contact layer 49 to be flush with the upper surface of the Ni electrode 47*a*. Alternatively, it is also possible to etch slightly the Ni electrode so as to allow the upper surface of the Ni electrode 47*a* to be somewhat lower than the upper surface of the contact layer 49. In this case, it is possible for a large number of recesses to be formed on the upper surface of the contact layer 49 such that the upper surface of the Ni electrode 47*a* is exposed to the outside within these recesses.

Also, a beam 43 is formed to extend over the first contact layer 49 and the gate electrodes 48*a*, 48*b*. Also, supporting legs 43*a*, 43*b* on both sides of the beam 43 are fixed to the undoped polycrystalline diamond thin film 11. In other words, the beam 43 includes two supporting legs 43*a*, 43*b* arranged outside the gate electrodes 48*a*, 48*b*. That portion of the beam 43 which is interposed between the supporting leg portions 43*a* and 43*b* are supported by the supporting leg portions 43*a*, 43*b* so as to be positioned to face the members formed on the undoped polycrystalline diamond thin film 11 including the first contact layer 49 and the gate electrodes 48*a*, 48*b* with a gap provided between the particular portion of the beam 43 and the members formed on the undoped polycrystalline diamond thin film 11 including the first contact layer 49 and the gate electrodes 48*a*, 48*b*.

A contact 44 positioned to face the first contact layer 49 is formed in the bridge portion joining the supporting leg portions 43*a*, 43*b*. A large number of fine holes are also formed in the contact 44 by a method similar to the method employed in the first embodiment of the present invention described previously, and a Ni electrode 47*b* is buried inside these large number of fine holes. The Ni electrode 47*b* is also constructed to form an array of a large number of slender columnar Ni layers. Incidentally, the etching of the Ni electrode 47*b* is not carried out until the etched portion extends to reach the fine hole formed in the contact 44 such that a Ni layer 47*c* is left unremoved on the upper surface of the beam 43. A metal electrode 46 is formed on the Ni layer 47*c*, and a metal electrode 50 is formed in that region of the first contact layer 49 which correspond to both sides of the region having the beam 43 brought into contact therewith.

Incidentally, it is possible for the contact surface of the contact 44 to be flush with the lower surface of the Ni electrode 47*b*. Alternatively, it is also possible to etch slightly the Ni electrode 47*b* during or after removal of the sacrificial layer so as to form fine recesses on the contact surface of the contact 44 and to have the surface of the Ni electrode 47*b* formed within the recesses.

The microswitch according to the first embodiment of the present invention has a so-called "cantilever" structure. In this case, the free end of the cantilever is moved toward the substrate upon application of the gate voltage, with the result that the contact formed in the beam is brought into contact with the contact layer. Such being the situation, it is possible for the contact to be inclined so as to diminish the contact area. On the other hand, when it comes to the microswitch shown in FIGS. 4A and 4B, the beam is fixed at both edges, and the gate electrodes are arranged in symmetry with respect to the contact formed between the both edge portions of the beam. It follows that the contact is brought into contact with the contact layer without causing the contact to be inclined. Such being the situation, it is possible to increase the contact area, with the result that the on-resistance can be further lowered.

The present invention is not limited to the embodiments described above. For example, the contact is formed of diamond, which is a carbon-based material, in each of the embodiments described above. However, it is possible for the contact to be formed of graphite, which is also a carbon-based material, in place of diamond. Graphite resembles diamond in that the sticking problem is unlikely to take place. However, graphite has a problem similar to that of diamond that the resistivity of the graphite is several places higher than that of the metal. It follows that the contact made of graphite produces the effect similar to that produced in the case of using the contact made of diamond.

Also, the metal layer forming the porous film is not limited to an Al layer. For example, it is possible to use Ti, Ta or Cu in place of Al for forming the porous film. Further, the buried metal is not limited to Ni. It is also possible to use other metals such as Au, Ag, Pt and Cu in place of Ni.

It is also possible to form in advance a metal layer below the contact layer (diamond layer), and to form in the diamond layer a group of fine holes extending to reach the metal layer. In this case, each of the fine holes included in the fine hole group is filled with a metal, and the metal layer is electrically connected to the external metal electrode through, for example, via holes. The particular construction makes it possible to permit the metal buried in each fine hole to be electrically connected to the external metal electrode, with the metal layer noted above used as a take-out electrode, so as to further lower the on-resistance.

Further, in each of the embodiments described above, the beam is moved in a direction perpendicular to the substrate surface so as to carry out the switching operation. However, the technical idea of the present invention can also be applied to the construction that the beam is moved in a direction parallel to the substrate surface so as to carry out the switching operation.

In order to prevent without fail the sticking problem, it is desirable for the surface of at least one of the first metal material group and the second metal material group to be positioned within the fine hole included in the first fine hole group or the second fine hole group. Particularly, it is desirable for the surface of at least one of the first metal material group and the second metal material group to be positioned in the vicinity of the open portion of each fine hole, e.g., to be positioned in a region not remoter than 1 $\mu$m from the open portion, in order to sufficiently lower the on-resistance.

It is desirable for the first and second carbon series material layer to be formed of a diamond doped with an n-type or p-type impurity or to be formed of graphite.

It is desirable for the density of the fine holes included in the fine hole group to fall within a range of between $10^9/cm^2$ and $10^{11}/cm^2$.

It is desirable for the diameter of each of the fine holes included in the fine hole group to fall within a range of between 10 nm and 100 nm.

Also, it is desirable to remove selectively the layer remaining in the bottom portion of the porous film by the etching such as an anisotropic etching prior to the anisotropic etching.

Also, it is desirable to employ a method such as a plating method for burying the metal material portion in the fine hole group.

According to an aspect of the present invention, the first metal material portion and the second metal material portion each having a low resistivity are buried in the fine hole groups of the first and second carbon series material layers, respectively, so as to diminish sufficiently the distance of the contact portion between the first and second carbon series material layers through which flows an electric current from the first metal material portion and the second metal material portion. It follows that it is possible to markedly lower the on-resistance without giving rise to the problem in respect of, for example, the mechanical strength. As a result, it is possible to provide a microswitch using a carbon series material layer having a low on-resistance while utilizing the high reliability of the carbon series material.

Particularly, in the case of employing the method such as an anodic oxidation, it is possible to form fine holes having a diameter of scores of nanometers, which are arranged at a distance substantially equal to the diameter of the fine hole. As a result, it is possible to decrease markedly the distance of the contact point between the first and second carbon series material layers through which flows an electric current from the first metal material portion and the second metal material portion, with the result that the on-resistance can be decreased markedly.

Additional advantages and modifications will readily occur to those skilled in the art. Therefore, the present invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A microswitch, comprising:

a substrate;

a first electrode portion fixed to the substrate and having a first contact surface, the first electrode portion including a first layer formed of a first carbon series material and provided with a group of first fine holes extending to reach the first contact surface, and first metal segments formed of a first metal material and buried in the first fine holes, respectively;

a second electrode portion arranged to face the first electrode portion with a gap provided therebetween and having a second contact surface movable toward the first electrode portion, the second electrode portion including a second layer formed of a second carbon series material and provided with a group of second fine holes each extending to reach the second contact surface, and second metal segments formed of a second metal material and buried in the second fine holes, respectively; and a deformable structure configured to support the second electrode portion on the substrate to face the second contact surface to the first contact surface with a gap in a non-contact state, and configured to be deformed to shift the second electrode portion and contact the second contact surface with the first contact surface in a contact state.

2. The microswitch according to claim 1, wherein the first fine hole extends through the first layer toward the first contact surface, and the second fine hole extends through the second layer toward the second contact surface.

3. The microswitch according to claim 1, wherein the substrate has a surface, the deformable structure includes a base portion fixed to the substrate and a movable portion extending from the base portion along the surface of the substrate with a second gap, and the second electrode portion is fixed to the movable portion.

4. The microswitch according to claim 3, wherein the first fine hole extends through the first layer toward the first contact surface, and the second fine extends through the second layer toward the second contact surface.

5. The microswitch according to claim 1, further comprising a first contact layer electrically connected to the first metal segments, and a second contact layer electrically connected to the second metal segments.

6. The microswitch according to claim 1, wherein the first layer and the first metal segment have a coincident surface on the first contact surface.

7. The microswitch according to claim 1, wherein the second layer and the second metal segments have a coincident surface on the second contact surface.

8. The microswitch according to claim 1, wherein the first fine holes are opened on the first contact surface, and the first metal segment has an end defining recess in the corresponding first fine hole.

9. The microswitch according to claim 1, wherein the second fine holes are opened on the second contact surface, and the second metal segment has an end defining recess in the corresponding second fine hole.

10. The microswitch according to claim 1, wherein each of the first and second carbon series material is a material selected from the group consisting of diamond doped with an n-type or p-type impurity and graphite.

11. A method of manufacturing a microswitch, comprising:

forming a first electrode portion having a first contact surface on a substrate such that the first electrode portion is fixed to the substrate, the forming the first electrode portion including:

forming a first carbon series material layer on the substrate;

forming a first metal layer on the first carbon series material layer;

subjecting the first metal layer to an anodic oxidation within an acidic solution so as to form a first porous film in at least a surface region of the first metal layer;

subjecting the first carbon series material layer to an anisotropic etching with the first porous film used as a mask so as to form a group of first fine holes; and burying a first metal material in each of the first fine holes;

forming a second electrode portion positioned to face the first electrode portion with a gap, the second electrode portion having a second contact surface movable toward the first electrode portion, the forming the second electrode portion including:

forming a sacrificial layer having a pattern on the substrate;

forming a second carbon series material layer on the sacrificial layer and on the substrate;

forming a second metal layer on the second carbon series material layer;

subjecting the second metal layer to an anodic oxidation within an acidic solution so as to form a second porous film in at least a surface region of the second metal layer;

subjecting the second carbon series material layer to an anisotropic etching with the second porous film used as a mask so as to form a group of second fine holes; and burying a second metal material in each of the second fine holes; and forming a deformable structure configured to support the second electrode portion on the substrate to face the second contact surface to the first contact surface with a gap in a non-contact state, and configured to be deformed to shift the second electrode portion and contact the second contact surface with the first contact surface in a contact state, the forming the deformable structure including removing the sacrificial layer.

12. The method of manufacturing a microswitch according to claim 11, wherein the metal layer is formed of one material selected substantially from the group consisting of aluminum, titanium, tantalum, copper and an alloy thereof.

* * * * *

UNITED STATES PATENT AND TRADEMARK OFFICE

CERTIFICATE OF CORRECTION

PATENT NO. : 6,753,488 B2
DATED : June 22, 2004
INVENTOR(S) : Ono et al.

It is certified that error appears in the above-identified patent and that said Letters Patent is hereby corrected as shown below:

Title page,
Item [73], Assignee, should read as follows:
-- [73] Assignee: Kabushiki Kaisha Toshiba, Tokyo (JP) --

Signed and Sealed this

Twenty-third Day of November, 2004

JON W. DUDAS
*Director of the United States Patent and Trademark Office*